US009263856B2

(12) United States Patent
Kretschmar et al.

(10) Patent No.: US 9,263,856 B2
(45) Date of Patent: Feb. 16, 2016

(54) ELECTRODE FOR A SPARK PLUG AND METHOD FOR ITS PRODUCTION

(75) Inventors: Thomas Kretschmar, Bamberg (DE); Andreas Benz, Bamberg (DE); Jochen Fischer, Bamberg (DE)

(73) Assignee: ROBERT BOSCH GMBH, Stuttgart (DE)

( * ) Notice: Subject to any disclaimer, the term of this patent is extended or adjusted under 35 U.S.C. 154(b) by 115 days.

(21) Appl. No.: 14/125,044

(22) PCT Filed: Apr. 12, 2012

(86) PCT No.: PCT/EP2012/056643
§ 371 (c)(1),
(2), (4) Date: Mar. 26, 2014

(87) PCT Pub. No.: WO2012/167972
PCT Pub. Date: Dec. 13, 2012

(65) Prior Publication Data

US 2014/0203701 A1 Jul. 24, 2014

(30) Foreign Application Priority Data

Jun. 9, 2011 (DE) ..... 10 2011 077 279

(51) Int. Cl.
*H01T 13/20* (2006.01)
*H01T 13/39* (2006.01)
*H01T 21/02* (2006.01)

(52) U.S. Cl.
CPC ..... *H01T 13/39* (2013.01); *H01T 21/02* (2013.01)

(58) Field of Classification Search
CPC ..... H01T 13/28; H01T 13/39; H01T 21/02
USPC ..... 313/144; 445/7
See application file for complete search history.

(56) References Cited

U.S. PATENT DOCUMENTS

| | | | | |
|---|---|---|---|---|
| 6,791,194 | B1 * | 9/2004 | Nagai et al. | 257/783 |
| 6,853,116 | B2 | 2/2005 | Hori et al. | |
| 7,923,909 | B2 * | 4/2011 | Tinwell | 313/141 |
| 8,487,520 | B2 * | 7/2013 | Sakayanagi et al. | 313/142 |
| 2002/0105254 | A1 | 8/2002 | Hori et al. | |
| 2002/0130603 | A1 * | 9/2002 | Teramura et al. | 313/141 |
| 2005/0176332 | A1 * | 8/2005 | Juestel et al. | 445/7 |
| 2007/0103046 | A1 | 5/2007 | Tinwell | |

FOREIGN PATENT DOCUMENTS

| | | | |
|---|---|---|---|
| DE | 102 05 078 | A1 | 9/2002 |
| EP | 936710 | | 8/1999 |
| EP | 0936710 | A1 | 8/1999 |
| EP | 1049222 | | 11/2000 |
| EP | 1049222 | A1 | 11/2000 |
| EP | 2020713 | | 2/2009 |
| JP | 2003-217792 | | 7/2003 |
| JP | 2003-217792 | A | 7/2003 |
| JP | 2004-095214 | | 3/2004 |
| JP | 2004-095214 | A | 3/2004 |
| JP | 2010-238499 | | 10/2010 |
| JP | 2010-238499 | A | 10/2010 |

* cited by examiner

*Primary Examiner* — Sikha Roy
(74) *Attorney, Agent, or Firm* — Kenyon & Kenyon LLP

(57) ABSTRACT

An electrode for a spark plug includes an electrode base material and a noble metal element, the noble metal element being fastened to the electrode base material using a welding connection. The welding connection has a maximum extension perpendicular to an area of the electrode at which the noble metal element is fastened, and the welding connection has a maximum width at the area. A ratio of the maximum extension to the maximum width is greater than, or equal to 3.

18 Claims, 3 Drawing Sheets

ELECTRODE FOR A SPARK PLUG AND METHOD FOR ITS PRODUCTION

CROSS REFERENCE TO RELATED APPLICATIONS

The present application is the national stage entry of International Patent Application No. PCT/EP2012/056643, filed on Apr. 12, 2012, which claims priority to Application No. DE 10 2011 077 279.0, filed in the Federal Republic of Germany on Jun. 9, 2011.

FIELD OF INVENTION

The present invention relates to an electrode for a spark plug and a method for its production, an excellent service life of a noble metal element on an electrode base material being provided.

BACKGROUND INFORMATION

An electrode for a spark plug is described in German Application No. DE 102 05 078, in which a noble metal platelet is welded onto a base material of the electrode, using laser welding. In this connection, a large molten section is created of molten materials of the base electrode and the noble metal platelet of more than 50 vol.-% of the noble metal platelet. It therefore becomes necessary to use a large quantity of costly noble metal to produce the electrode. This, however, leads to high production costs of the electrode.

SUMMARY

The electrode according to the present invention has an advantage that the quantity of the noble metal for the electrode is able to be reduced significantly. According to the present invention, a welding connection is now generated between the noble metal element and an electrode base material, which has a ratio of a maximum depth T of the welding connection perpendicular to a surface of the electrode to a maximum width B of the welding connection at the electrode surface, which is greater than, or equal to 3 ($T/B \geq 3$). By maintaining this ratio at the welding seam between the noble metal element and the electrode base material, it is ensured that the welding seam does not become too large and that too much of the noble metal element is not used up in a molten section of the welding connection. Because of this, electrodes may be produced for spark plugs which, in spite of the use of lesser noble metal elements, nevertheless provide sufficient noble metal at the electrode. This measure is able to improve the service life of the electrode considerably.

Preferably 50 vol.-% or less of the noble metal material is molten together with the electrode base material in the welding seam. It is ensured thereby that the welding seam does not become excessively thick, and that still sufficient noble metal material is present for a long service life.

Particularly preferred is a volume of the noble metal element before welding in a range of 0.015 to 0.2 $mm^3$, preferably between 0.075 to 0.15 $mm^3$ and further preferred, approximately 0.1 $mm^3$.

A particularly good service life of the electrode according to the present invention is achieved if the noble metal element is a ball. The ball preferably has a diameter of 0.3 to 0.75 mm, preferably 0.4 to 0.6 mm, and further preferred, appropriately 0.5 mm.

Alternatively, the noble metal element is a noble metal platelet, preferably having a cylindrical shape having a diameter between 0.4 to 2.6 mm. For vehicle engines, the diameter is preferably between 0.4 to 0.8 mm, preferably 0.5 to 0.7 mm, and especially preferred, approximately 0.6 mm. For stationary gas engines, the diameter is preferably between 2.2 to 2.6 mm, and is preferably approximately 2.4 mm. The thickness of the noble metal platelet is preferably in a range between 0.2 to 0.7 mm, preferably 0.25 to 0.6 mm, and especially preferred, approximately 0.3 mm. For vehicle engines, the thickness is preferably approximately 0.3 mm, and for stationary gas engines, preferably about 0.6 mm.

Particularly preferred, the welding seam is provided to be essentially perpendicular to an electrode surface.
Alternatively, the welding seam is provided at an angle to the electrode surface, preferably at an angle of 0° to 60°.

According to another preferred exemplary embodiment of the present invention, the welding seam is formed without interruption on the outer circumference of the noble metal element. Further preferred, the maximum width of the welding seam is in a range of 0.1 to 0.3 mm, and particularly preferred about 0.2 mm. The maximum depth is preferably in a range of 0.3 to 0.9 mm, and particularly preferred 0.6 mm.

Further preferred, the present invention relates to a spark plug having an electrode according to the present invention, as well as a method for producing an electrode, in a first step, an electrode base material being provided and a noble metal element being positioned on a surface of the electrode base material. The noble metal element is subsequently welded onto the electrode base material such that an aspect ratio of a depth T of the welding connection to a width B of the welding connection present at the outer side is ≥3. The welding takes place, in this context, especially preferred using a laser, particularly a fiber laser. Further preferred, a proportion of 50 vol.-% or less of the noble metal element is welded, so that sufficiently pure noble metal is still present on the noble metal element so that the service life of the electrode is very good without too great a quantity of costly noble metal having to be used.

Exemplary embodiments of the present invention are described in detail below with reference to the accompanying drawings.

DETAILED DESCRIPTION

Figure 1:
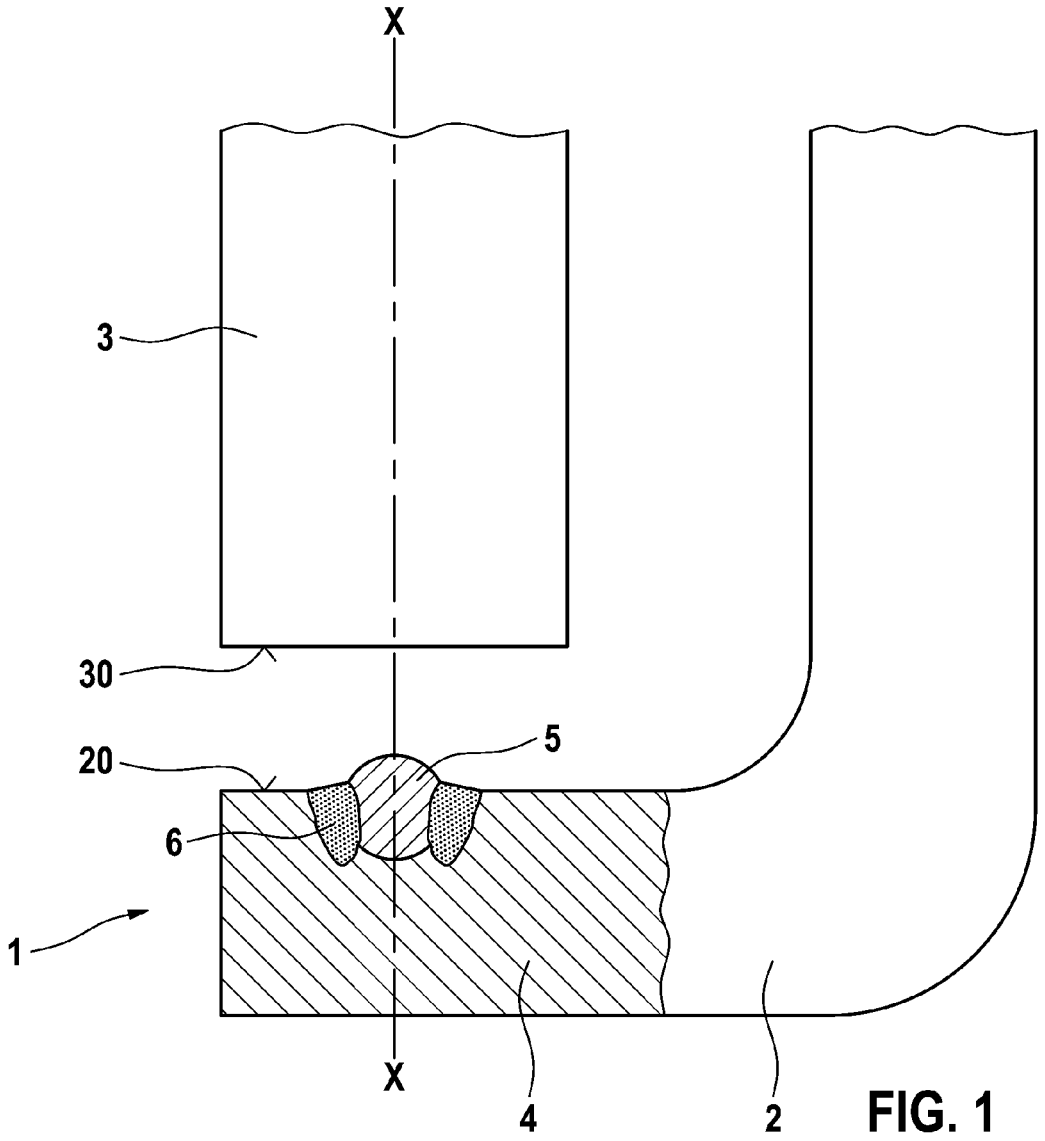
FIG. 1 is a schematic, partially sectioned side view of the end, on the combustion chamber side, of a spark plug according to a first exemplary embodiment of the present invention.
Figure 2:
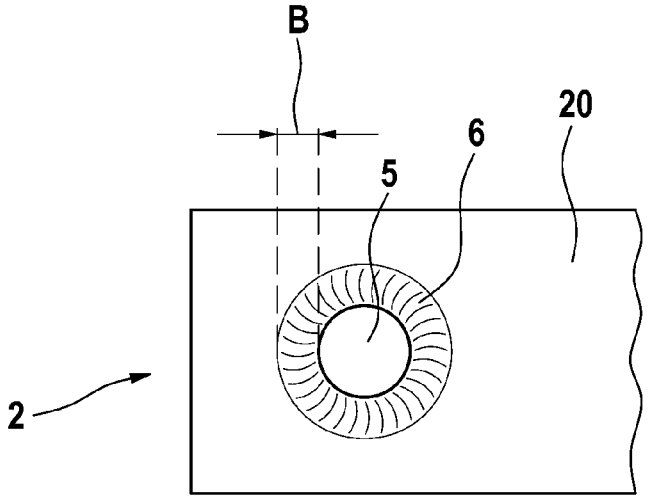
FIG. 2 is a schematic partial top view onto the ground electrode of FIG. 1.
Figure 3:
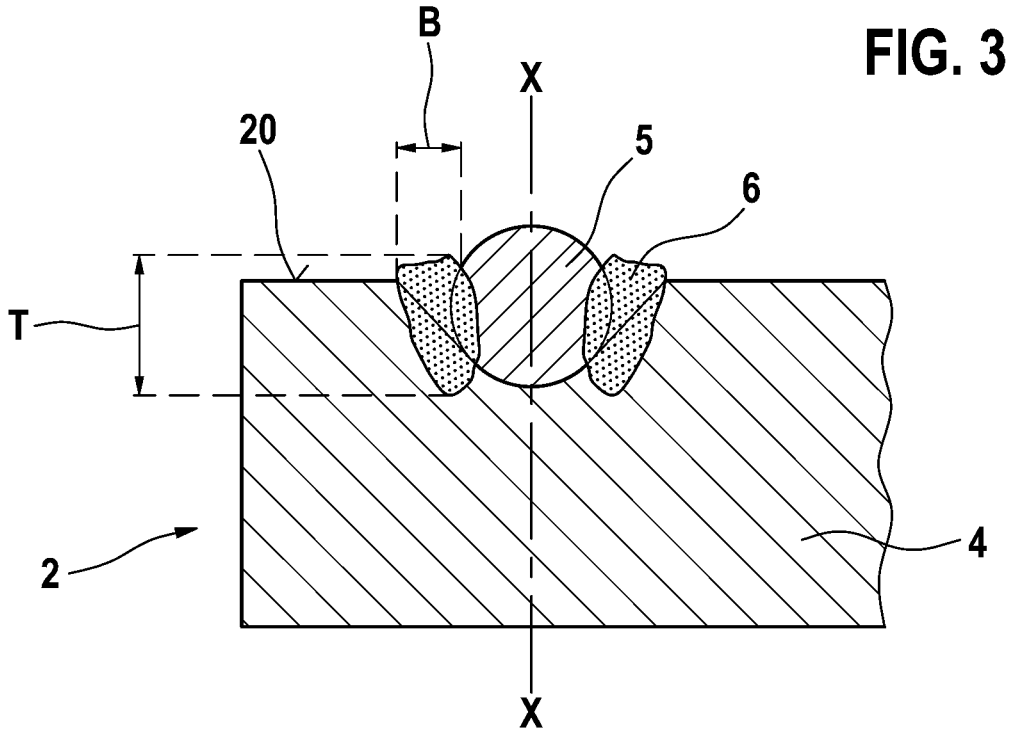
FIG. 3 is a schematic sectional view of the ground electrode of FIG. 1.

With reference to FIGS. 1 through 3, an electrode for a spark plug 1 according to a first exemplary embodiment of the present invention is described.

As may be seen in the schematic view of FIG. 1, spark plug 1 includes a ground electrode 2 and a center electrode 3, which is situated on a center axis X-X of the spark plug. In this described exemplary embodiment, the electrode according to the present invention is ground electrode 2. It should be noted, though, that the electrode according to the present invention may also be center electrode 3, or that both electrodes may be executed in the manner according to the present invention.

As may be seen in FIG. 1, ground electrode 2 has an area 20, which is directed towards the other electrode and is situated perpendicular to center axis X-X, in this context. Center electrode 3 has an area 30, which is directed towards the ground electrode and is also aligned perpendicular to center axis X-X.

Ground electrode 2 includes an electrode base material 4, made of a material which contains no noble metal, such as a nickel alloy. Furthermore, ground electrode 2 includes a noble metal element 5, which is fastened to electrode base material 4 using a welding connection 6. In this exemplary embodiment, noble metal element 5 is a ball and welding connection 6 is developed to be annular around the ball, as shown in FIG. 2.

As may be seen in the enlargement in FIG. 3, welding connection 6 is designed so that welding connection 6 has a maximum depth T in axial direction X-X, i.e., the maximum extension of the welding seam parallel to center axis X-X. In parallel to area 20, welding connection 6 further has a maximum width B at the surface (cf. also FIG. 2). Width B of welding connection 6 is defined as the maximum length of the welding seam in a radial direction from center axis X-X of the spark plug at the surface of welding connection 6. Welding connection 6 of this exemplary embodiment is produced using a fiber laser, so that a high beam quality is ensured, in order to produce welding connection 6 as homogeneously as possible. For welding connection 6, in this context, both material of noble metal element 5 and of electrode base material 4 are molten, and the material molten together then forms welding connection 6. The aspect ratio of the maximum extension T of welding connection 6 in the axial direction X-X to a maximum width B parallel to area 20 is greater than, or equal to 3 ($T/B \geq 3$), in this instance. As will become clear from FIG. 3, in this case less than 50% of the volume of noble metal element 5 is included in welding connection 6. Because of this, a large noble metal volume remains present (in this exemplary embodiment more than 80%), whereby a very long service life of the spark plug is obtained at a minimum use of noble metal. In this exemplary embodiment, a maximum width B is 0.2 mm and a maximum extension T in the axial direction X-X is 0.7 mm, so that an aspect ratio of 3.5 is obtained ($0.7/0.2=3.5$).

The welding process for fastening noble metal element 5 to electrode base material 4 is performed, in this instance, in a step before ground electrode 2 is bent over through 90°. An original diameter of the ball-shaped noble metal element was 0.5 mm, in this context. Consequently, for the method according to the present invention, particularly the use of a fiber laser makes it possible to obtain a very accurate welding seam having a very constant width and a very constant extension in axial direction X-X of the spark plug. As an alternative, instead of a fiber laser, another type of laser may also be used for the welding.

Consequently, the present invention, in a surprisingly simple manner, provides the ability to save noble metal in making spark plugs, without reducing the service life of the spark plug. By saving in the use of noble metal, in this case in particular, the production of the spark plug may be made significantly cheaper. Since spark plugs are mass production components, large savings potentials arise because of this. It should further be noted that the service life of the spark plug may be further improved if both ground electrode 2 and center electrode 3 have a welded-on noble metal element having an aspect ratio of ≥3, as defined according to the present invention.

Figure 4:
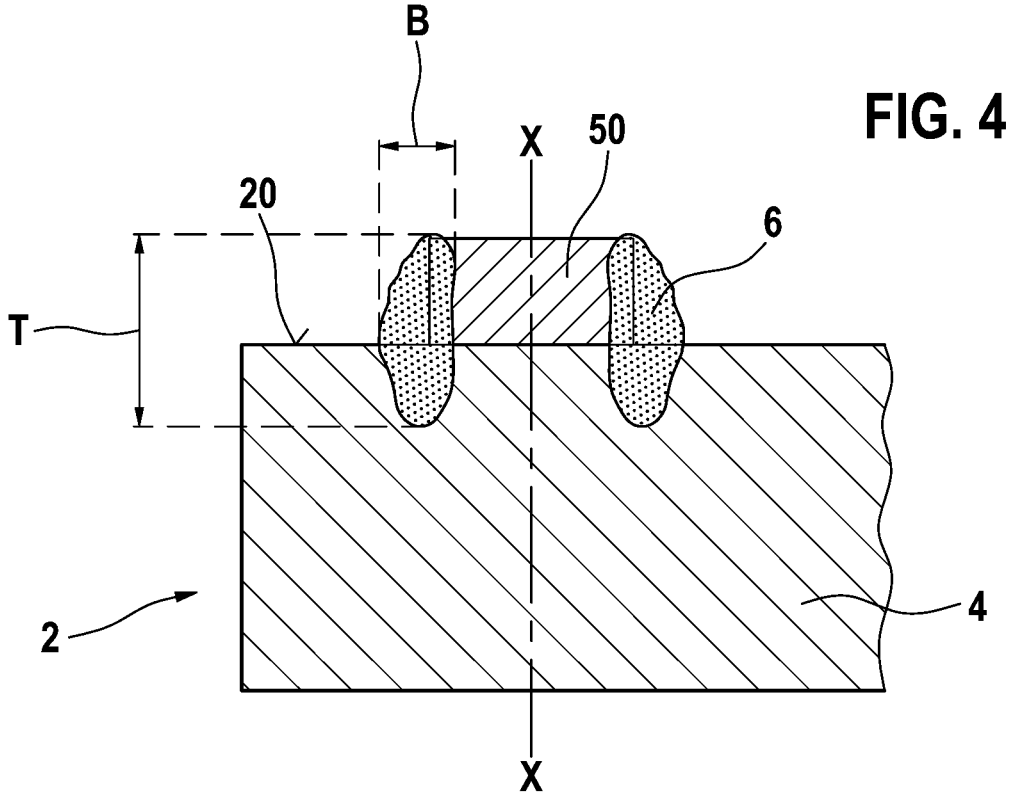
FIG. 4 is a schematic sectional view of a ground electrode according to a second exemplary embodiment of the present invention.
Figure 5:
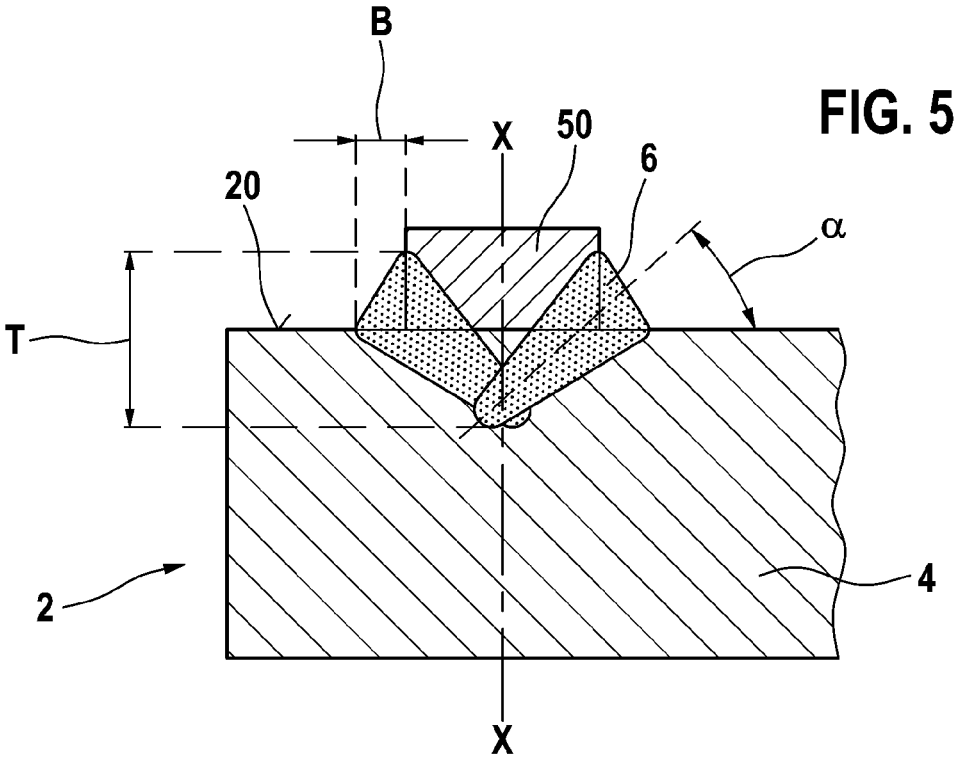
FIG. 5 is a schematic sectional view of a ground electrode according to a third exemplary embodiment of the present invention.
Figure 6:
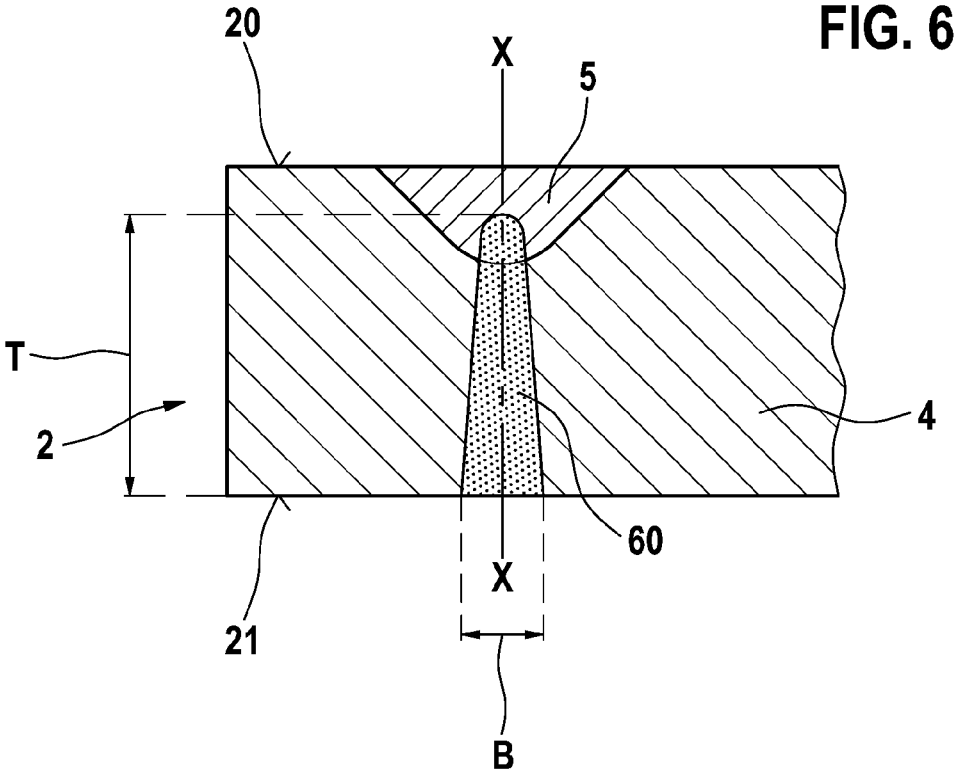
FIG. 6 is a schematic sectional view of a ground electrode according to a fourth exemplary embodiment of the present invention.

FIGS. 4 through 6 show preferred exemplary alternatives of fuel injector 1; identical or functionally equivalent parts have been provided with the same reference numerals as in the first exemplary embodiment.

FIG. 4 shows the use of a platelet made of noble metal as a noble metal element 50. The noble metal platelet is formed as a smaller cylinder and is welded to electrode base material 4 using a welding connection 6. Whereas in the first exemplary embodiment, in FIGS. 1 through 3, approximately a depth of the welding seam in the axial direction X-X defined the axial extension of the welding connection, in the second exemplary embodiment the axial spreading of welding connection 6 is formed for the most part at the lateral circumferential edge of noble metal element 50. This aspect ratio of maximum depth T to maximum width B on the surface of the electrode is greater than, or equal to 3.

In the third exemplary embodiment of FIG. 5, as in the case of the second exemplary embodiment, a noble metal platelet is used as noble metal element 50. To be sure, the main welding direction in the third exemplary embodiment is no longer selected as in the second exemplary embodiment, essentially parallel to center axis X-X, but rather at an angle $\alpha$ of about 40°. A funnel-shaped welding connection 6 is thereby obtained, which lies partially below noble metal element 50. In this welding connection 6, too, the aspect ratio is $T/B \geq 3$, the width B of welding connection 6 being given by a projection of the maximum spreading, directed maximally radial to center axis X-X, of welding connection 6 at the surface.

FIG. 6 shows a fourth exemplary embodiment of the present invention, noble metal element 5, which was originally also a ball, is welded from an opposite side 21 on ground electrode 2. Because of this, on the one hand, no annular welding seam comes about, as in the preceding exemplary embodiments, but a welding seam that is essentially cylindrical, which extends from opposite side 21 to a bottom region of noble metal element 5. In this context, welding connection 60 is executed such that it does not exit from noble metal element 5 at area 20 directed towards the center electrode. Consequently, there comes about a particularly large area of noble metal element 5 which is directed towards the center electrode.

Welding connection 60 of this exemplary embodiment is developed in center axis X-X of the spark plug, and runs slightly conically in the direction towards noble metal element 5. In this context, a width B of the fourth exemplary embodiment corresponds to a diameter of welding connection 60 on opposite side 21. An extension of welding connection 60 running in the direction of center axis X-X corresponds, in this context, to depth T of the welding connection in ground electrode 2. Besides the previously mentioned advantage that the entire area, directed towards the other electrode, of noble metal element 5 is available at the spark generating region of the spark plug, the fourth exemplary embodiment further has the advantage that a point-shaped welding is possible, so that the cost of the welding system is able to be clearly reduced, since no relative motions are required between the electrode and the welding device.

As a result, according to the present invention, an improved electrode for spark plugs may be provided, which, in spite of low noble metal use, has a very long service life. It may also be ensured, according to the present invention, that the welding seam is kept as small as possible. In particular, it is possible, according to the present invention, that noble metal elements having a volume in the range of 0.015 to 0.2 $mm^3$ are able to be welded on, 50% or less of the noble metal volume being molten with the electrode base material.

What is claimed is:

1. An electrode for a spark plug, comprising:

an electrode base material; and a noble metal element fastened to the electrode base material using a welding connection;

wherein the welding connection has a maximum extension perpendicular to a surface of the electrode, to which the noble metal element is fastened, and the welding connection has a maximum width at the surface; and wherein a ratio of the maximum extension to the maximum width is greater than, or equal to 3, and wherein 50 vol.-% or less of a material of the noble metal element is molten with the electrode base material in the welding connection.

2. The electrode according to claim 1, wherein a volume of the noble metal element is between 0.015 to 0.2 $mm^3$.

3. The electrode according to claim 1, wherein the noble metal element is a ball.

4. The electrode according to claim 3, wherein the noble metal element has a diameter of between 0.3 to 0.75 mm.

5. The electrode according to claim 1, wherein the noble metal element is a noble metal platelet having at least one of the following: a diameter of between 0.4 to 0.8 mm, or a thickness in a range of between 0.2 to 0.4 mm.

6. The electrode according to claim 1, wherein the welding connection is essentially perpendicular to the electrode surface.

7. The electrode according to claim 1, wherein the welding connection is formed at an angle $\alpha$ to the electrode surface.

8. The electrode according to claim 1, wherein one of:

the welding connection is formed without interruption on an outer circumference of noble metal element, or the welding connection is introduced from an opposite side of the electrode that is directed opposite to the surface and fixes the noble metal element to the surface of the noble metal element that is directed towards the electrode base material.

9. The electrode according to claim 1, wherein a width of the welding connection is between 0.1 and 0.3 mm, and/or a depth of the welding connection is between 0.3 and 0.9 mm.

10. The electrode according to claim 2, wherein a volume of the noble metal element is approximately 0.1 $mm^3$.

11. The electrode according to claim 3, wherein the noble metal element has a diameter of between 0.4 to 0.6 mm.

12. The electrode according to claim 3, wherein the noble metal element has a diameter of approximately 0.5 mm.

13. The electrode according to claim 5, wherein the noble metal element is a noble metal platelet having a diameter of between 0.5 to 0.7 mm.

14. The electrode according to claim 5, wherein the noble metal element is a noble metal platelet having a diameter of approximately 0.6 mm.

15. The electrode according to claim 5, wherein the noble metal element is a noble metal platelet having a thickness of approximately 0.3 mm.

16. A spark plug, including at least one electrode, the electrode comprising:

an electrode base material; and a noble metal element fastened to the electrode base material using a welding connection;

wherein the welding connection has a maximum extension perpendicular to a surface of the electrode, to which the noble metal element is fastened, and the welding connection has a maximum width at the surface; and wherein a ratio of the maximum extension to the maximum width is greater than, or equal to 3, and wherein 50 vol.-% or less of a material of the noble metal element is molten with the electrode base material in the welding connection.

17. A method for producing an electrode, comprising:

providing an electrode base material;

positioning a noble metal element on the electrode base material; and welding the noble metal element to the electrode base material such that a welding connection has a ratio of a maximum extension of the welding connection perpendicular to an electrode surface to a maximum width of the welding connection at the surface of the electrode that is greater than, or equal to 3, and 50 vol.-% or less of a material of the noble metal element is molten with the electrode base material in the welding connection.

18. The method according to claim 17, wherein the welding is performed using a laser, or a fiber laser.

* * * * *